US005377500A

United States Patent [19]

Yang

[11] Patent Number: 5,377,500

[45] Date of Patent: Jan. 3, 1995

[54] WATER COOLED AIR CONDITIONER

[75] Inventor: Ten S. Yang, Taipei, Taiwan, Prov. of China

[73] Assignee: Fast Maker Enterprise Co., Ltd., Chitu, Taiwan, Prov. of China

[21] Appl. No.: 70,806

[22] Filed: Jun. 3, 1993

[51] Int. Cl.[6] ..... F25B 39/04

[52] U.S. Cl. ..... 62/238.6; 62/305; 62/310; 62/506

[58] Field of Search ..... 62/238.6, 238.7, 181, 62/183, 184, 299, 305, 304, 171, 506, 310, 314; 261/DIG. 11

[56] References Cited

U.S. PATENT DOCUMENTS

| | | | |
|---|---|---|---|
| 2,518,299 | 8/1950 | Fernandez | 62/299 |
| 2,894,377 | 7/1959 | Shikles, Jr. et al. | 62/299 X |
| 3,052,105 | 9/1962 | Bowman et al. | 62/305 |
| 3,099,915 | 8/1963 | Andersson | 62/305 |
| 3,130,557 | 4/1964 | McFarlan | 62/171 |
| 3,507,322 | 4/1970 | Tetrick et al. | 62/299 X |
| 3,992,896 | 11/1976 | Jason et al. | 62/299 X |
| 4,270,359 | 6/1981 | Hummel | 62/238.7 X |
| 4,293,093 | 10/1981 | Raymond et al. | 62/238.6 X |
| 4,327,561 | 5/1982 | McNeal et al. | 62/238.6 X |
| 4,588,026 | 5/1986 | Hapgood | 62/238.7 X |
| 4,697,434 | 10/1987 | Yuyama | 62/238.7 |
| 5,003,789 | 4/1991 | Gaona et al. | 62/305 X |
| 5,004,047 | 4/1991 | Meier et al. | 62/238.7 X |

*Primary Examiner*—Harry B. Tanner

*Attorney, Agent, or Firm*—Morton J. Rosenberg; David I. Klein

[57] ABSTRACT

An improved water cooled air conditioner having a compressor, an evaporator, a cooling fan, a low pressure pipe, a high pressure pipe, a radiator, a cooling motor, and a condenser is provided. The apparatus is characterized in that the heat exchanging efficiency between the cooling water and the refrigerant is highly enhanced thereby intensifying the cooling effect and increasing the temperature of the cooling water flowing out of the apparatus to an acceptable degree for use as residential hot water. Further, the heated water from the radiator may be sprayed on to the external surface of the radiator to provide evaporative cooling thereof.

7 Claims, 9 Drawing Sheets

WATER COOLED AIR CONDITIONER

BACKGROUND OF THE INVENTION

It has been found that the small air conditioners on the market are cooled by air and so the efficiency thereof is very low, thereby wasting much energy. Further, the heat exhausted by such air conditioners will pollute and increase the temperature of the environment. As to the large air conditioners on the market, they are usually cooled by water. However, the heat of the refrigerant exchanged with the cooling water in these air conditioners still are not fully utilized.

Therefore, it is an object of the present invention to provide an improved water cooled air conditioner which may obviate and mitigate the above-mentioned drawbacks.

SUMMARY OF THE INVENTION

This invention relates to an improved water cooled air conditioner.

It is the primary object of the present invention to provide a water cooled air conditioner which utilizes a condenser with a special coil pipe to increase the heat exchanging efficiency, thereby increasing the cooling effect and the temperature of the cooling water flowing out of the apparatus to an acceptable degree.

It is another object of the present invention to provide a water cooled air conditioner of which the radiator may be separated from the apparatus.

It is still another object of the present invention to provide a water cooled air conditioner which may supply hot water to the user .

It is still another object of the present invention to provide a water cooled air conditioner which may save a lot of energy.

It is still another object of the present invention to provide a water cooled air conditioner which is economic to produce.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
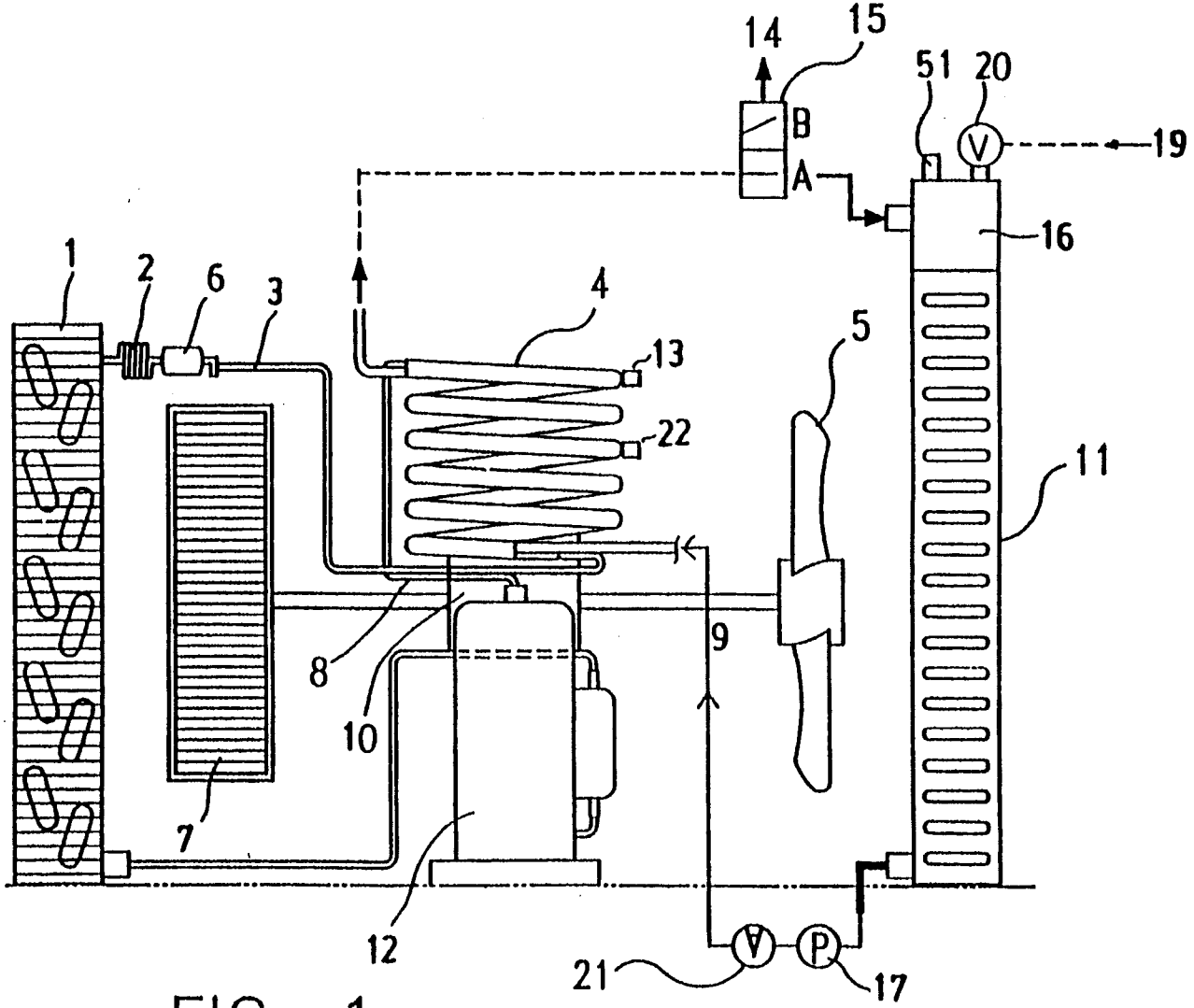
FIG. 1 is a schematic diagram of the present invention.

With reference to the drawings and in particular to FIG. 1 thereof, the present invention mainly comprises a compressor 12, an evaporator 1, a cooling fan 7, a condenser outlet pipe 3, a condenser inlet pipe 8, a radiator 11, a cooling motor 10, a condenser 4, a first sensor 13, and a second sensor 22.

The compressor 12 is used to compress the refrigerant, which is well known in the art and need not be described here in detail.

The evaporator 1 is a device where the liquid refrigerant is evaporated rapidly thereby providing a cooling effect. Further, the evaporator 1 is connected to the condenser 4 through the condenser outlet pipe 3, a filter 6 and a capillary tube 2.

The cooling fan 7 is mounted beside the evaporator 1 and is used to make a current of air across the evaporator 1 thereby lowering the temperature of the air current.

The condenser outlet pipe 3 is used to connect the outlet at the lower portion of the condenser 4 with the evaporator 1 so as to transmit the liquid pressure refrigerant from the condenser 4.

The radiator 11 is provided with a water tank 16 and utilizes a pump 17 to force the cooling water to flow through a throttle valve 21 into the coil pipe of the condenser 4. Then, the cooling water will flow into the water tank 16 under the selection control of a three-way solenoid valve 15 or will flow out from the hot water outlet 14 of the three-way solenoid valve 15.

The cooling motor 10 is used to drive the cooling fan 5 to make air current across the radiator 11 so as to further lower the temperature thereof.

The condenser 4 is a coil pipe which the high temperature and high pressure refrigerant will be forced into and will become liquid in.

The first sensor 13 is mounted on the upper portion of the condenser 4 for detecting the temperature flowing out of the condenser 4 and is used to control the opening of a water control valve 20. In addition, the first sensor 13 is set at a temperature such as, for example, of 50 degrees centigrade, so that when the temperature of the water exceeds 50 degrees centigrade, the water control valve 20 will be turned open at a larger degree, so as to increase the amount of water into the condenser 4 from the water supplying source 19.

The second sensor 22 is installed approximately on the intermediate portion of the coil pipe of the condenser 4 and located under the first sensor 13. The second sensor 22 is used to control the shut-off of the water control valve 20 and set a temperature such as, for example, of 45 degrees centigrade so that when the water temperature is below 45 degrees centigrade, the water control valve 20 will be turned open at a smaller degree thereby keeping the water at a temperature between 45–50 degrees centigrade.

The present invention resides in four characteristics, i.e. the structure of the coil pipe of the condenser, the structure of the radiator, the hot water supplying system, and the rapid connector. The characteristics will be described in detail as follows.

Figure 2A:
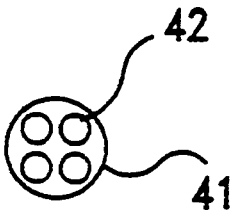
FIG. 2A shows the cross-section of a first preferred embodiment of the coil pipe.
Figure 2B:
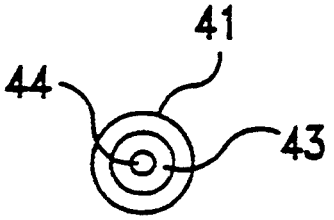
FIG. 2B shows the cross-section of another preferred embodiment of the coil pipe.
Figure 2:
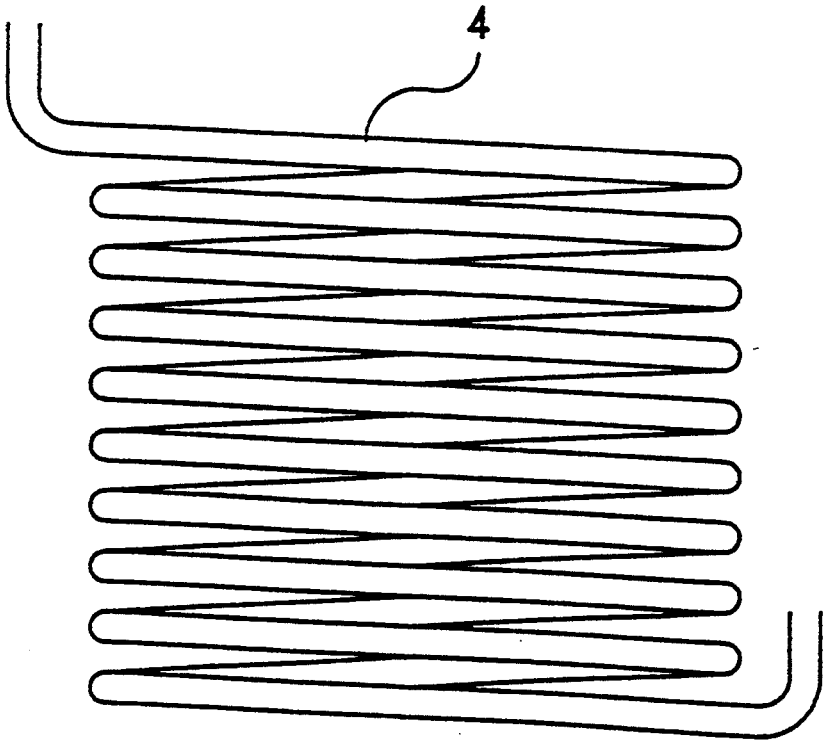
FIG. 2 is a front view of the coil pipe of the condenser.

As illustrated in FIGS. 2 and 2A, the condenser 4 is composed of a coil pipe which includes an outer pipe 41 and a plurality of inner pipes 42. The relationship between the outer pipe 41 and the inner pipes 42 is that the center lines of these pipes 41 and 42 are not coincident with each other. That is, a plurality of inner pipes 42 with smaller diameter than the outer pipe 41 are inserted into the outer pipe 41. The inner pipes 42 are designed for the passage of cooling water while the outer pipe 41 for the passage of high temperature and high pressure refrigerant. Thus, the heat exchanging area between the refrigerant and the cooling water will be equal to the sum of the outer surface areas of the inner pipes 42 thereby effectively increasing the temperature of the cooling water. Hence, the refrigerant may be effectively reduced in temperature at one hand, and the cooling water may be effectively increased at the other.

FIG. 2B show another preferred embodiment of the coil pipe of the condenser 4. As may be seen, the coil pipe of the condenser 4 is composed of an outer pipe 41, an intermediate pipe 43 and an inner pipe 44. The relationship between the outer pipe 41, the intermediate pipe 43 and the inner pipe 44 are that their center lines lie on the same axis. In short, the inner pipe 44 is inserted into the intermediate pipe 43 and the intermediate pipe 43 is in turn inserted into the outer pipe 41. The inner pipe 44 and the outer pipe 41 are designed for the passage of cooling water, while the intermediate pipe 43 for the passage of high temperature and high pressure refrigerant. Hence, the heat exchanging area between the refrigerant and the cooling water will be equal to sum of the outer area of the intermediate pipe 43 and the outer area of the inner pipe 44.

Figure 3:
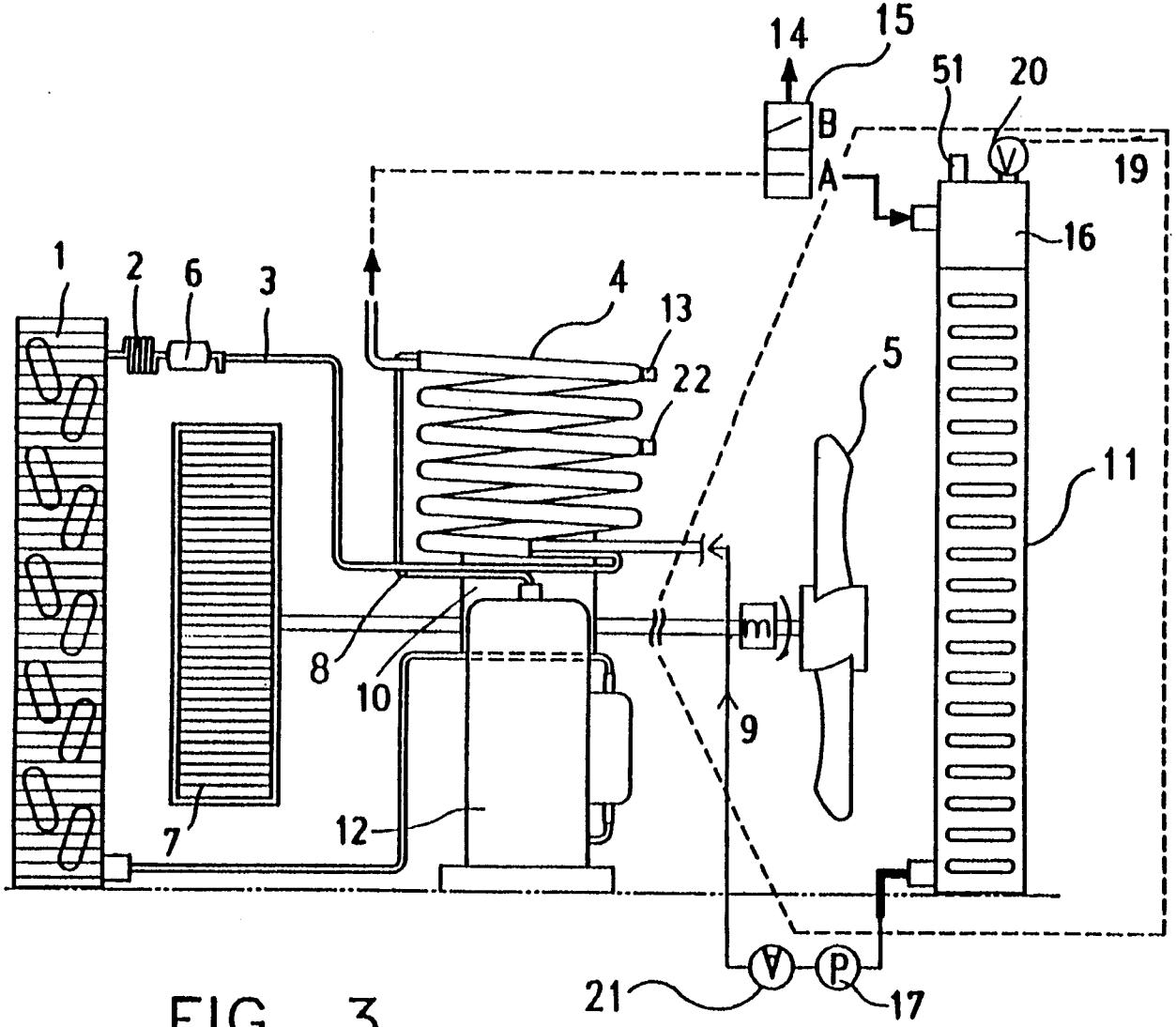
FIG. 3 shows the way to separate the radiator together with the cooling fan from the apparatus.

The other characteristic of the present invention resides in the structure of the radiator 11. As shown in FIG. 3, the water from the water supplying source 19 will first flow into the water tank 16 through the water control valve 20 and then into the radiator 11. Then, the pump, 17 will force the cooling water to flow through the throttle valve 21. Thereafter, the cooling water will enter into the coil pipe of the condenser 4 via the water inlet 9, where the cooling water exchanges heat with the high temperature and high pressure refrigerant. Thus, the cooling water becomes hot water and flows out of the coil pipe of the condenser 4. Then, the cooling water will flow into the water tank 16 and the radiator 11. The fan 5 is used to expedite the cooling of the radiator 11 and the cooling water is circulated. Further, the cooling fan 5 and the radiator 11 may be separated from the apparatus so as to be adapted for use in various circumstances. When desired to use hot water, the three-way solenoid 15 is controlled to cause the hot water to flow out of its hot water outlet 14.

Figure 4:
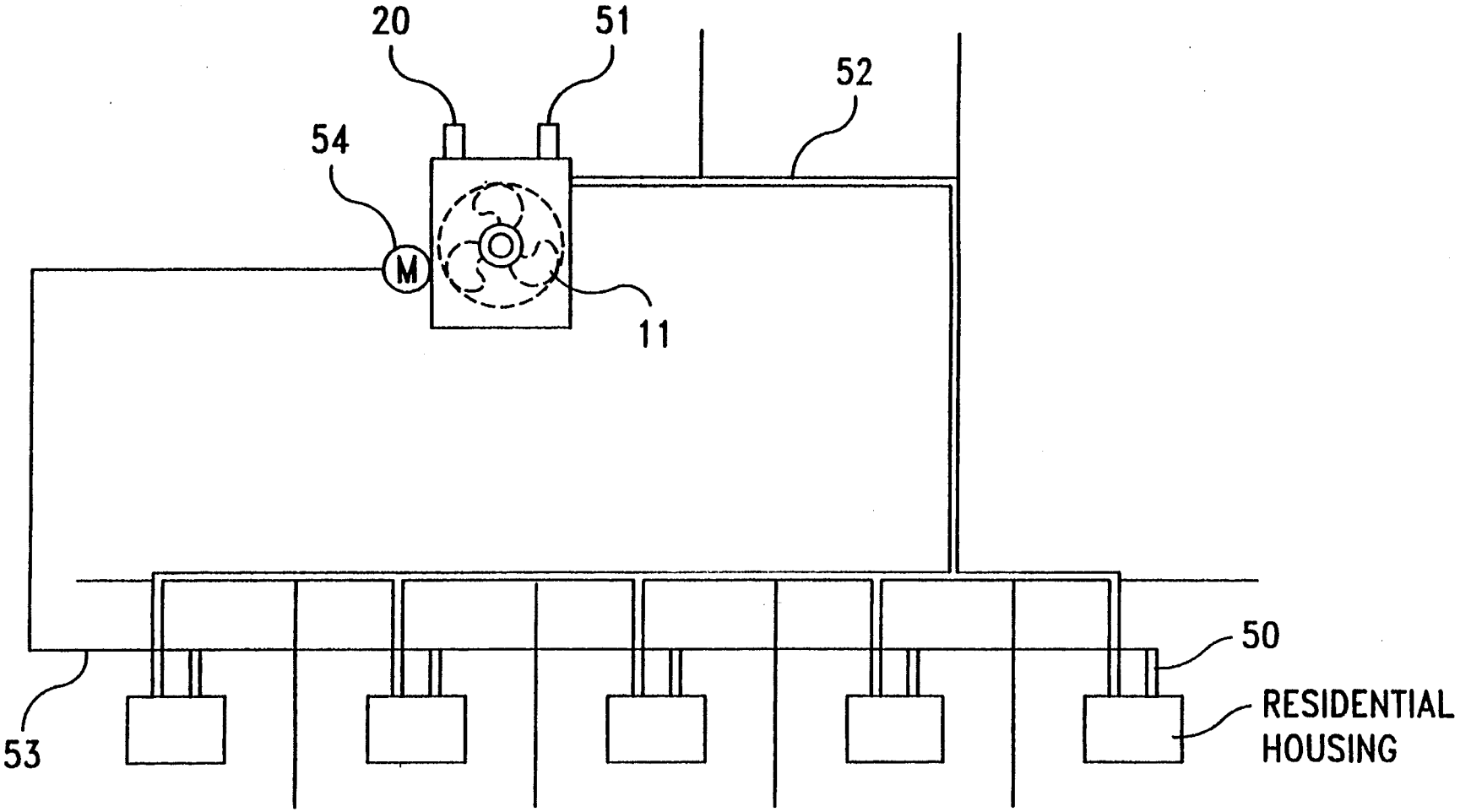
FIG. 4 illustrates the way to supply hot water from the resent invention to the hot water piping of a house.

The third characteristic of the present invention resides in the retrieval of the cooling water after exchanging heat with the refrigerant thereby saving energy and reducing heat pollution. As illustrated in FIG. 4, the cooling fan 5 and the radiator 11 are separated from the apparatus and connected with the water outlet of the apparatus via piping 52 and with the water inlet of the apparatus via piping 53. The piping 52 is connected with the hot water supplying piping of residential housing so that when the hot water faucet is open, the hot water derived from the cooling water, by exchanging heat with the refrigerant, will be transmitted to the hot water faucet through the piping 52. Further, the water tank 16 is provided with a float bowl 51 for measuring the water level. As the water level is found lower than a predetermined value, the float bowl 51 will send a signal to open the water inlet control valve 20 so as to supplement water from the water supplying source 19. When it is not desired to use hot water, the cooling water from the present invention will flow back into the water inlet 50 and will be circulated therein.

Figure 5:
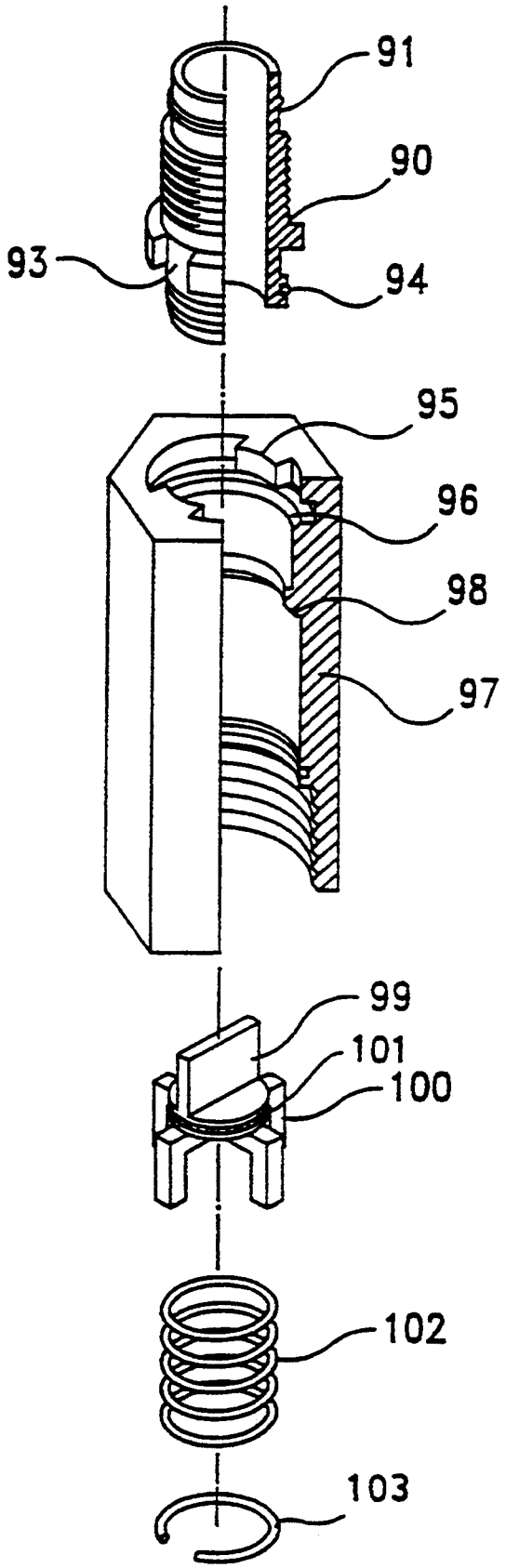
FIG. 5 is an exploded view of a rapid connector.
Figure 6:
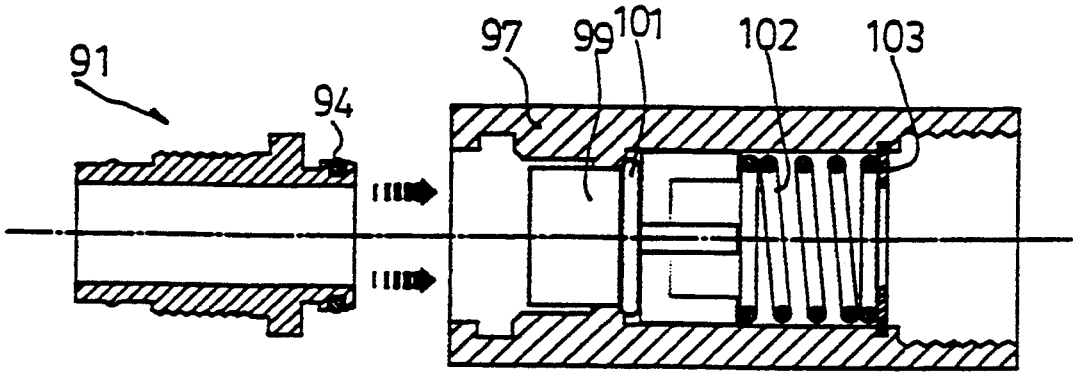
FIGS. 6 and 6A show the working principle of the present invention.
Figure 6A:
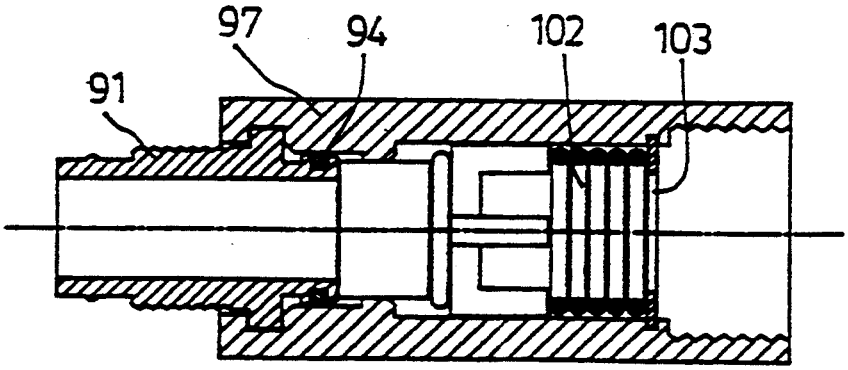

The fourth characteristic of the present invention is directed to a rapid connector which is used to connect a water supplying source 19 to the water tank 16. Referring to FIGS. 5, 6 and 6A, the rapid connector mainly comprises a male member 90, a female member 97, a latch bolt 99, and a spring 102. The female member 97 is connected with the water supplying source by screw threads or the like and is formed with two opposite protuberances 95, an upper inclined edge 96 under the protuberances 95, and a lower inclined edge 98 under the upper inclined edge 96. The intermediate portion of the latch bolt 99 is provided with a rubber ring 101 adapted for engaging with the lower edge 98 of the female member 97. The male member 90 has an end 91 for engaging with a flexible pipe (not shown), two opposite slots 93 adapted to receive the protuberances 95 of the female member 97, and a rubber ring 94 for engaging with the upper inclined edge 96 of the female member 97.

In use, the female member 97 is connected with the water supplying source and the male member 90 is connected with the flexible pipe connected with the water control valve 20. In the meantime, the rubber ring 101 will bear against the lower edge 98 of the female member 97 thereby preventing water leakage.

For coupling the male and female members, the slots 93 of the male member 90 are aligned with the protuberances 95 of the female member 97 and then the male member 90 is rotated, so as to prevent the male member 90 from detaching from the female member 97. As the male member 90 is inserted into the female member 97, the rubber ring 94 of the male member 90 will first bear against the upper inclined edge 96 of the female member 97 so as to prevent water from leaking out of the female member 97. Then, as the male member 90 is further inserted into the female member 97, the latch bolt 99 will be forced to go backward and so the rubber ring 101 of the latch bolt 99 will no longer bear against the lower inclined edge 98 of the female member 97 thereby enabling water to flow into the male member 90 through the clearance between the latch bolt 99 and the female member 97. When not in use, the male member 90 is rotated to align the slots 93 with the protuberances 95 and pull out the male member 90 which is then withdrawn from the female member 97. Meanwhile, the spring 102 will urge the latch bolt 99 to go upwards and the rubber ring 101 will bear against the lower inclined edge 98 of the female member 97 thereby preventing water from spraying out of the female member 97.

It has been found that the large conventional water cooled air conditioner utilizes a cooling tower to lower the temperature of the cooling water. However, the utilization of cooling water still has the following drawbacks:

1. a large amount of water drops will be blown away by the cooling fan thereby wasting water;
2. as the efficiency of heat dissipation is low, it is necessary to increase the horsepower of the compressor so as to improve the cooling effect;
3. the heat dissipation of the exhaust hot water is unsatisfactory and so it is necessary to use a large cooling fan;
4. as the compressor and the cooling fan must be increased in horsepower, the volume of the whole system will be enlarged;
5. it is noisy;

6. it is necessary to use a large motor;
7. it is of a low working efficiency thus wasting energy.

In consequence, a water spraying device or a mist spraying device (shown in FIGS. 7A, 7B and 7C) is mounted on the radiator so as to obviate the above-mentioned drawbacks.

As shown in FIG. 7, the top of the radiator 11 is provided with a vertical tube 111 which is pivotally connected with a horizontal pipe 112 thereby enabling the horizontal pipe 112 to rotate about the vertical tube 111. In addition, the vertical tube 111 is connected to a water outlet of the radiator 11. The horizontal pipe 112 has a plurality of perforations so that the exhaust water pressure of the radiator 11 will rotatively propel the horizontal pipe 112 about the vertical tube 111, as the exhaust water flows from the perforations of the horizontal pipe 112 and drips down on the radiator 11. The cooling fan 5 is used to accelerate the evaporation of the water drops on the radiator 11. Thus, causing an efficient cooling effect and thereby lowering the temperature of the radiator 11. Water which has not evaporated is fed back to the water inlet for circulation.

Figure 7A:
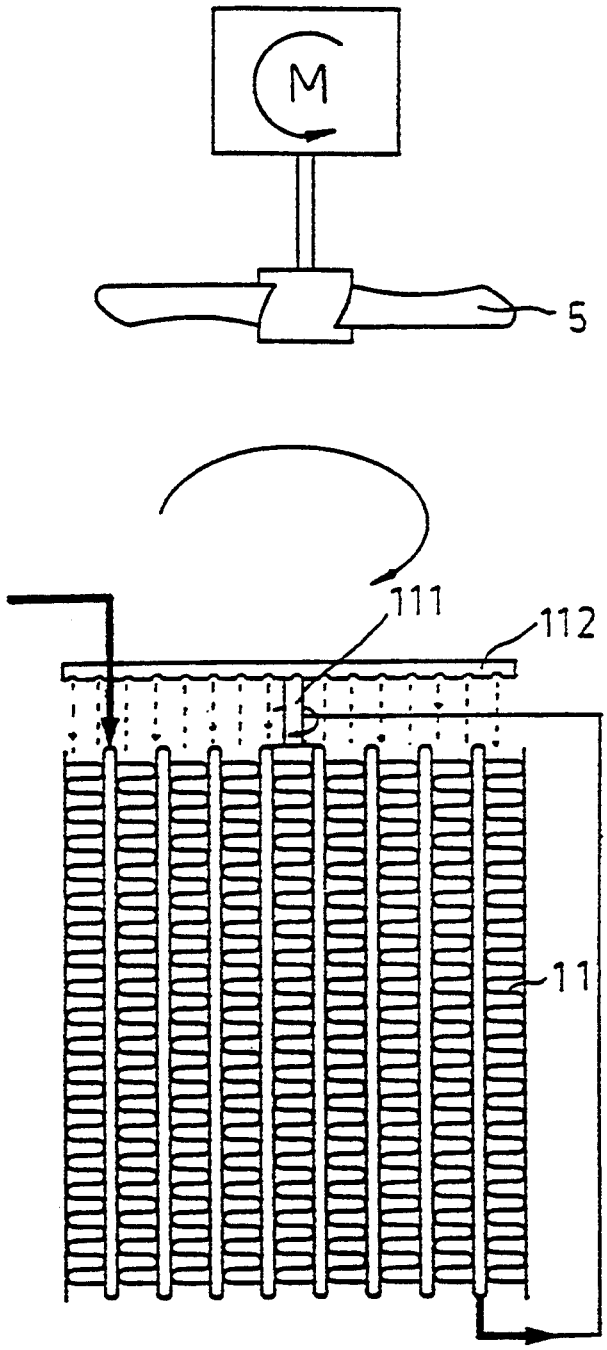
FIG. 7A shows another preferred embodiment of the radiator.

The radiator 11 shown in FIG. 7A will further decrease the temperature of the exhaust water by 2–3 degrees centigrade and has the following advantages:

1. increasing the cooling effect;
2. increasing the heat dissipation efficiency and decreasing the volume thereby facilitating its transportation and assembly;
3. lowering the consumption power and saving energy;
4. reducing the cost; and,
5. saving water (the amount of water lost is just equal to amount of water evaporated).

Further, the horizontal pipe 112 may be also driven by a small motor (not shown) so as to provide a regular and slow rotation.

Figure 7B:
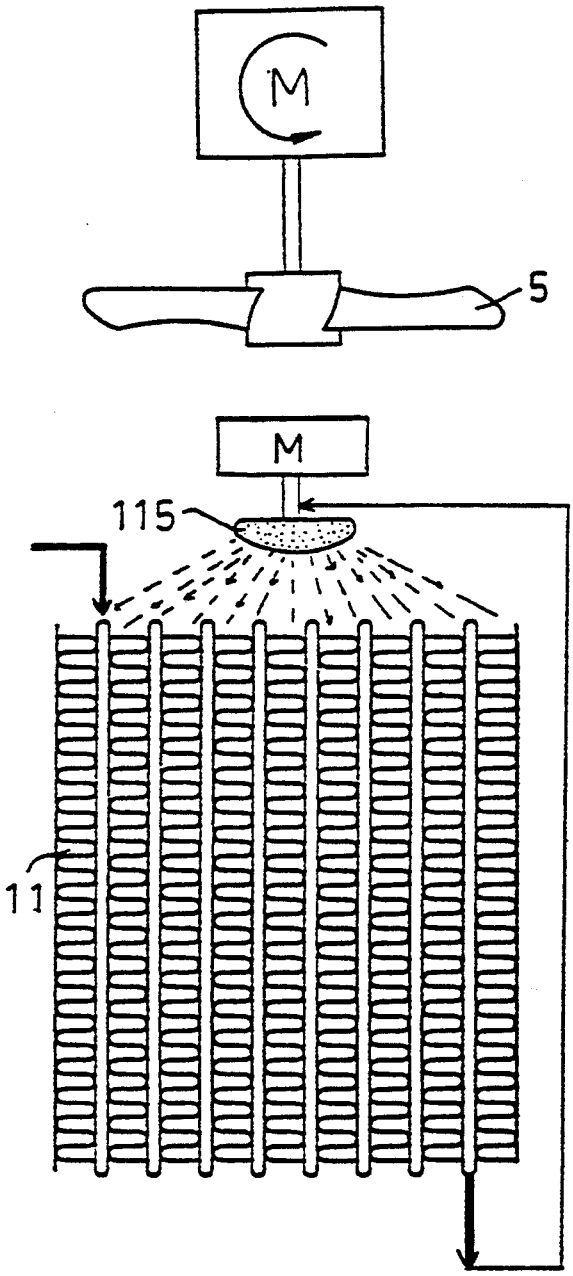
FIG. 7B shows a third preferred embodiment of the radiator.
Figure 7C:
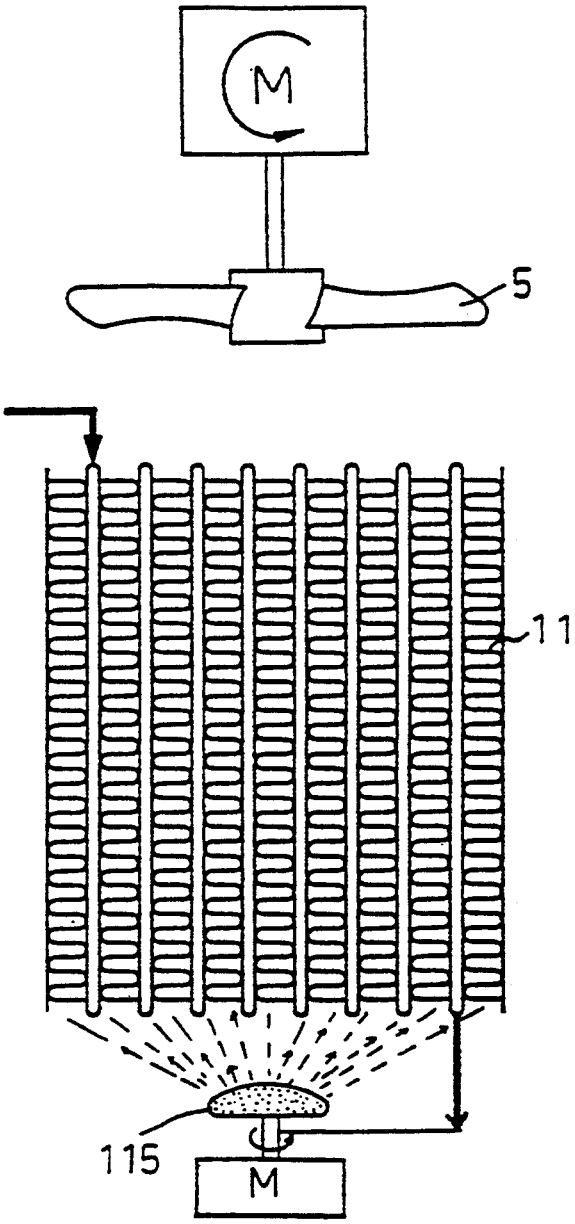
FIG. 7C shows a fourth preferred embodiment of the radiator.

FIG. 7B shows a third preferred radiator wherein the water spraying device is replaced with a mist spraying device 115 which is driven by a motor M. When in use, a large amount of water vapor is sprayed on the surface of the radiator 11 and a cooling fan 5 is driven to accelerate the evaporation of the water drops on the radiator 11 thereby causing an efficient cooling effect and increasing the heat dissipation efficiency.

FIG. 7 shows a fourth preferred radiator wherein the mist spraying device 115 may be also mounted under the radiator 11.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A water cooled air conditioner, comprising:

a compressor for pressurizing a refrigerant, said compressor having an inlet port and an outlet port;

an evaporator having an outlet port fluidly coupled to said compressor inlet port;

condensing means having a refrigerant input line coupled in fluid communication with said compressor outlet port and a refrigerant output line coupled in fluid communication with an inlet port of said evaporator for condensing said refrigerant from a gaseous state at a first temperature to a liquid state at a second temperature, said first temperature being higher than said second temperature, said condensing means including (1) a first conduit fluidly coupled to said refrigerant input line on one end thereof and fluidly coupled to said refrigerant output line on an opposing end for carrying said refrigerant therebetween, and (2) at least one second conduit extending through said first conduit for carrying cooling water therethrough, wherein heat from said refrigerant in said first conduit is transferred to said cooling water within said at least one second conduit; and, means for displacing said cooling water coupled in fluid communication with said second conduit, said coolant displacement means including a coolant pump having an outlet coupled in fluid communication with a first end of said second conduit, a radiator having an inlet coupled in fluid communication with a second end of said second conduit, and means for evaporative cooling of said radiator, said evaporative cooling means including (1) a fan for displacing air across said radiator in a first direction, (2) spraying means having an inlet coupled in fluid communication with an outlet of said radiator and a plurality of outlet orifices for spraying cooling water effluent from said radiator on an external surface of said radiator, and (3) means for collecting said cooling water effluent sprayed on said external surface of radiator having an outlet coupled in fluid communication with an inlet of said coolant pump.

2. The water cooled air conditioner as recited in claim 1 where said spraying means includes a rotatively driven perforate member coupled in fluid communication with said radiator outlet for dispersing said cooling water effluent on said external surface of said radiator.

3. The water cooled air conditioner as recited in claim 2 where said perforate member dispenses said cooling water effluent as a mist.

4. The water cooled air conditioner as recited in claim 1 where said outlet orifices dispense said cooling water effluent in said first direction.

5. The water cooled air conditioner as recited in claim 1 where said outlet orifices dispense said cooling water effluent in a second direction, said second direction being opposite said first direction.

6. The water cooled air conditioner as recited in claim 1 where said condensing means further includes a third conduit extending external said first conduit in concentric spaced relationship therewith, said third conduit being coupled on opposing ends thereof in fluid communication with respective opposing ends of said second conduit for carrying said coolant water through both said second and third conduits.

7. The water cooled air conditioner as recited in claim 1 where said condensing means further includes a plurality of second conduits extending through said first conduit for carrying cooling water therethrough, each of said plurality of second conduits having a first end coupled in fluid communication with said outlet of said coolant pump and a second end coupled in fluid communication to said inlet of said radiator.

* * * * *